US007665193B2

(12) United States Patent
Hasegawa et al.

(10) Patent No.: US 7,665,193 B2
(45) Date of Patent: Feb. 23, 2010

(54) METALLIC DOUBLE-SIDED ELEMENT AND SLIDE FASTENER

(75) Inventors: Hajime Hasegawa, Toyama-ken (JP); Manami Ohno, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 12/167,415

(22) Filed: Jul. 3, 2008

(65) Prior Publication Data

US 2009/0013505 A1 Jan. 15, 2009

(30) Foreign Application Priority Data

Jul. 10, 2007 (JP) ..... 2007-181184

(51) Int. Cl.
*A44B 19/06* (2006.01)

(52) U.S. Cl. ..... 24/410

(58) Field of Classification Search ..... 24/403, 24/408–410
See application file for complete search history.

(56) References Cited

U.S. PATENT DOCUMENTS 2,622,295 A * 12/1952 Mikulas ..... 24/410
4,306,347 A * 12/1981 Kasai ..... 29/410

FOREIGN PATENT DOCUMENTS

CN 2669667 Y 12/2005
EP 1568422 A 8/2005
JP H01-80012 9/1989

* cited by examiner

*Primary Examiner*—James R Brittain
(74) *Attorney, Agent, or Firm*—Darby & Darby PC

(57) ABSTRACT

A metallic double-sided element comprising a coupling head includes: thin flat plate portions; coupling convex portions projecting at a central portion in the right-left direction of the thin flat plate portion; right and left raised portions which are raised in the front surface-rear surface direction from the thin flat plate portion disposed on the right and left sides of each of the coupling convex portions and integrated with the body portion; and a coupling concave portion which is formed surrounded by the coupling convex portion, the right and left raised portions and the body portion, wherein each of the right and left raised portions has a slope portion which is inclined from a front edge toward the body portion such that the slope portion rises thereof, part of each side face of the right and left slope portions is integrated with part of right and left side faces of the coupling convex portion in a face bonding manner.

9 Claims, 10 Drawing Sheets

METALLIC DOUBLE-SIDED ELEMENT AND SLIDE FASTENER

INCORPORATION BY REFERENCE

The present application claims priority under 35 U.S.C. §119 to Japanese Patent Application No. 2007-181184 filed on Jul. 10, 2007. The content of the application is incorporated herein by reference in its entirety.

BACKGROUND OF THE INVENTION

1. Field of the Invention

The present invention relates to a metallic double-sided element for a slide fastener, having a coupling convex portion and a coupling concave portion on both front and rear surfaces thereof.

2. Description of the Related Art

Slide fasteners have been widely used in an opening of bags or the like in order to open/close the bags or the like. As one of such slide fasteners, there is known a slide fastener in which two sliders are arranged on a fastener chain such that their heads oppose each other or their bottoms oppose each other, whereby the fastener chain can be opened/closed even when the slider is slid in any direction of forward and backward along element rows.

Double-sided elements are used in the slide fastener having the two sliders. Such a double-sided element is configured such that a coupling head thereof is formed into a symmetrical shape in regard to its front face and rear face (back to forth in a sliding direction) in order to provide operating feeling of the slider in each direction with no difference when the slider is slid forward or backward with respect to the element row. Particularly, the metallic double-sided element having excellent strength, appearance, durability and flexibility, etc. is used in the opening of clothes, bags and the like using strong fabric.

Examples of the double-sided elements have been disclosed in Japanese Utility Model Application Laid-Open No. 1-80012 (patent document 1), Chinese Utility Model Application Publication No. 2170665Y (patent document 2) and the like. A double-sided element 51 described in the patent document 1 as shown in FIG. 10 includes a coupling head 52, a body portion 53 disposed at the rear end side of the coupling head 52, and a pair of right and left leg portions 54a, 54b extending to the rear end side of the body portion 53.

The coupling head 52 includes a flat plate portion 52a thinner than the body portion 53, coupling convex portions 52b projecting from front and rear faces of the flat plate portion 52a, right and left projecting edge portions 52c disposed on both right and left side edges of the element 51 and projecting forward from the body portion 53, and a coupling concave portion 52d formed between the coupling convex portion 52b and the body portion 53. In the double-sided element 51 of the patent document 1, improvement of its coupling strength is achieved by forming the coupling convex portions 52b higher than the flat plate portion 52a when the element 51 is molded by pressing.

In this case, to provide the coupling convex portion 52b projectingly high in a predetermined shape, it is necessary to use the thickness around the coupling convex portion 52b. For the purpose, the right and left projecting edge portions 52c disposed on the coupling head 52 are formed with their projecting length from the body portion 53 limited, and the coupling convex portion 52b and the right and left projecting edge portions 52c are disposed apart from each other. Further, the height of the bottom face of the coupling concave portion 52d is set to the same one as the front and rear faces of the flat plate portion 52a, and the flat plate portion 52a is provided at the front end side of the coupling convex portion 52b.

According to the patent document 1, a front end face 52e of the flat plate portion 52a is formed wide and flat in the right-left direction. Thus, by constructing the slide fastener using the double-sided element 51 of the patent document 1, a chain width when the elements are coupled can be reduced so as to obtain a slide fastener having an excellent appearance.

On the other hand, the double-sided element 61 described in the patent document 2 as shown in FIGS. 11 and 12 includes a coupling head 62, a body portion 63, and a pair of right and left leg portion elements 64a, 64b, as shown in FIGS. 8 and 9. The coupling head 62 has a flat plate portion 62a formed thinly, a slope portion 62b disposed between the flat plate portion 62a and the body portion 63, and central convex portions 62c and right and left convex portions 62d projecting from the front and rear surfaces of the flat plate portion 62a.

The central convex portion 62c is disposed in the center in the right-left direction of the front end side of the flat plate portion 62a. Each side face of the front, rear, right and left sides is formed of an inclined face such that the bottom portion is expanded. The right and left convex portion 62d is disposed inside of right and left side edges of the element 61 and between the central convex portion 62c and the slope portion 62b while its peripheral face is formed in a tapered configuration. Particularly, the right and left convex portions 62d are constructed so that the edge on the front end side makes linear contact with the edge of the central convex portion 62c while its rear end is invading into the slope portion 62b.

In the double-sided element 61 of the patent document 2, a coupling concave portion 62e is formed among the central convex portion 62c, the right and left convex portions 62d and the slope portion 62b. Further, the height in the front surface-rear surface direction of each of the right and left convex portions 62d is set larger than the body portion 63, and the height in the front surface-rear surface direction of the central convex portion 62c is set larger than each of the right and left convex portions 62d. Because in the slide fastener constructed with the double-sided element 61 of the patent document 2, the heights of the central convex portion 62c and the right and left convex portions 62d are set higher than the body portion 63, the right and left elements 61 can be securely coupled with each other.

In the double-sided element 51 for the slide fastener described in the patent document 1 (see FIG. 7 10), the coupling convex portion 52b is provided projectingly on the front and rear surfaces of the flat plate portion 52 independently of the body portion 53 and the right and left projecting edge portions 52c. Assume that the slide fastener is constructed using the double-sided element 51 of the patent document 1. In this case, if the fastener element 51 receives an external force such as a lateral pulling force when the elements 51 are in coupling, the independent coupling convex portion 52b is likely to be deformed or chipped by its stress. In addition, the coupling convex portion 52b is hooked easily between the coupling convex portion 52b and the projecting edge portion 52c of a mating element, thereby providing a possibility that coupling strength may drop.

When the double-sided element 51 of this patent document 1 is attached to the fastener tape, the fastener tape is inserted in between the right and left leg portions 54a and 54b with the right and left leg portions 54a, 54b opened at a predetermined angle, and then the leg portions 54a, 54b are caulked inward, so that the elements are implanted successively at a predetermined pitch onto the element attaching portion of the fastener tape. However, when the right and left leg portions 54a, 54b of the element 51 are caulked in this way, the right and left leg portions 54a, 54b are deformed plastically to hold the fastener tape and at the same time, the coupling head 52 of the element 51, particularly, the right and left projecting edge portions 52c are deformed so that they are expanded outward. Consequently, there is a fear that the coupling state, coupling strength and the like of the element 51 might be affected when the slide fastener is constructed.

Further, because the double-sided element 51 of the patent document 1 is provided with the flat plate portion 52a formed on the front end side of the coupling convex portion 52b, sliding resistance is large when the slide fastener is opened or closed, whereby operation feeling of the slider is heavy. Additionally, the flat plate portion 52a may be formed on the front end side of the coupling convex portion 52b. In this case, for example, when a user touches an element row, he or she likely feels that the flat plate portion 52a is projected from the coupling head 52 and thus, there is a room for improvement in the tactile feeling and the like on the element rows.

On the other hand, the double-sided element 61 for the slide fastener described in the patent document 2 is so constructed that the central convex portion 62c and the right and left convex portions 62d keep contact through their edges, the peripheral wall of the coupling concave portion 62e is not formed continuously so that it is interrupted between the central convex portion 62c and the right and left convex portions 62d. Thus, the central convex portion 62c and the right and left convex portions 62d are not formed so as to support each other but the central convex portion 62c and the right and left convex portions 62d are provided substantially independently.

For this reason, the element 61 of the patent document 2 has such a problem that when a slide fastener is constructed with the elements, the central convex portion 62c is likely to be deformed or chipped thereby deteriorating its coupling strength, when the element receives a lateral pulling force or the like upon coupling of the elements 61 like the case of the patent document 1. Further, in the double-sided element 61 of the patent document 2, when the right and left leg portions 64a, 64b are caulked to attach the element to the fastener tape, the right and left convex portions 62d and the flat plate portion 62a disposed outside thereof are likely to be deformed such that they are expanded outward, like the case of the patent document 1.

Further, in the double-sided element 61 of the patent document 2, the flat plate portion 62a is disposed on the front end side of the central convex portion 62c also. Thus, when the slide fastener constructed with the double-sided elements 61 is opened or closed, a large sliding resistance is applied to the slider so that the operation feeling of the slider becomes heavy, thereby worsening the tactile feeling of the element rows, which is a disadvantage.

SUMMARY OF THE INVENTION

The present invention has been accomplished in views of the above-described problems of the prior art, and an object of the invention is to provide a metallic double-sided element in which even if a slide fastener receives a lateral pulling force or the like, a coupling head or a coupling convex portion is hard to deform or chip so as to secure an excellent coupling strength, and when caulked against a fastener tape, the coupling head can be prevented from being deformed and the operation feeling of a slider can be improved by reducing sliding resistance of the slider.

To achieve the above-described object, the present invention provides a metallic double-sided element including a coupling head, a body portion disposed on the rear end side of the coupling head, and a pair of right and left leg portions extending to the rear end side of the body portion, being characterized in that the coupling head includes: thin flat plate portions whose thickness between its front surface and rear surface is smaller than that of the body portion; coupling convex portions projecting in the front surface-rear surface direction at a central portion in the right-left direction of the thin flat plate portion; right and left raised portions which are raised in the front surface-rear surface direction from the thin flat plate portion disposed on the right and left sides of each of the coupling convex portions, and extend to the body portion so as to be integrated with the body portion; and a coupling concave portion which is formed surrounded by the coupling convex portion, the right and left raised portions and the body portion, each of the right and left raised portions has a slope portion which is inclined from a front edge on the coupling convex portion side of the raised portion toward the body portion such that the slope portion rises with respect to the front surface and rear surface of the thin flat plate portion, and part of each inside face of the right and left slope portions is integrated with part of right and left side faces of the coupling convex portion in a face bonding manner.

In the metallic double-sided element of the present invention, preferably, each of the right and left raised portions has an extending portion formed in a fixed thickness from the rear end of the slope portion to the body portion, and the front and rear surfaces of the extending portion are formed flush with the front and rear surfaces of the body portion. Preferably, the front edge on the coupling convex portion side of the slope portion is disposed forward of an apex portion of the coupling convex portion. Further, the inclined face of the slope portion is preferably formed in a plane.

Preferably, the right and left raised portions are formed between both right and left side edges of the element with the coupling convex portion and the coupling concave portion interposed therebetween. Further, the height from an apex portion of the coupling convex portion to a bottom face of the coupling concave portion is preferred to be set smaller than the height from the apex portion to the front surface or rear surface of the thin flat plate portion. Furthermore, the front end of the coupling convex portion is preferably disposed at the same position as the front edge of the thin flat plate portion.

Further preferably, the front edge of the raised portion is sloped or curved in order to increase an area of the inclined face of the slope portions gradually from the both right and left side edges of the element to the coupling convex portion.

On the other hand, the present invention provides a metallic double-sided element including a coupling head, a body portion disposed on a rear end side of the coupling head and a pair of right and left leg portions extending to the rear end side of the body portion, being characterized in that the coupling head includes: thin flat plate portions whose thickness between its front surface and rear surface is smaller than that of the body portion; coupling convex portions projecting in the front surface-rear surface direction at a central portion in the right-left direction of a thin flat plate portion; right and left raised portions which are raised in the front surface-rear surface direction from the thin flat plate portions disposed on the right and left sides of each of the coupling convex portions, and extend to the body portion so as to be integrated with the body portion; and a coupling concave portion which is formed surrounded by the coupling convex portion, the right and left raised portions and the body portion, each of the right and left raised portions has a slope portion which is inclined from a front edge on the coupling convex portion side of the raised portion toward the body portion such that the slope portion rises with respect to the front surface and rear surface of the thin flat plate portion, and part of each inside face of the right and left slope portions is formed continuously with part of right and left side faces of the coupling convex portion integrally, and the front edge of the raised portion is sloped or curved in order to increase an area of the inclined face of the slope portions gradually from the both right and left side edges of the element to the coupling convex portion.

Then, according to the present invention, there is provided a slide fastener including fastener stringers in which the metallic double-sided elements having the above-described configuration are arranged at predetermined intervals on side edge portions opposing each other of a pair of right and left fastener tapes.

The metallic double-sided element of the present invention has a coupling head, a body portion, and a pair of right and left leg portions. The coupling head includes thin flat plate portions, coupling convex portions projecting from the thin flat plate portions, right and left raised portions which are raised from the thin flat plate portions disposed on the right and left sides of each of the coupling convex portions, and extend to the body portion so as to be integrated with the body portion, and a coupling concave portion. The coupling concave portion is surrounded by the coupling convex portion, the right and left raised portions and the body portion while at least part of the peripheral wall is formed continuously. Each of the right and left raised portions has a slope portion which is inclined from a front edge on the coupling convex portion side of the raised portion toward the body portion such that the slope portion rises with respect to the front surface and rear surface of the thin flat plate portion. Part of each inside face of the right and left slope portions is integrated with part of right and left side faces of the coupling convex portion in a face bonding manner.

Because in the metallic double-sided element of the present invention having such a configuration, the coupling convex portion is integrated with the right and left raised portions in a face bonding manner, the coupling convex portion and the raised portion support each other and are formed so rigidly that they are hard to deform. Thus, when the slide fastener is constructed with the double-sided element of the present invention, the coupling convex portion and the right and left raised portions formed on the coupling head can be prevented from being deformed or chipped even if the slide fastener receives a lateral pulling force or the like while in coupling with the right and left elements.

Additionally, the coupling concave portion is surrounded by the coupling convex portion, the right and left raised portions and the body portion while the peripheral wall is formed continuously. Therefore, when the right and left double-sided elements are coupled, the coupling convex portion is fitted to the coupling concave portion of a mating element, thereby maintaining the coupling state stably. With this configuration, if the slide fastener is constructed with the double-sided elements of the present invention, an excellent coupling strength can be secured stably.

In addition, the right and left raised portions are formed on the thin flat plate portion such that they join with the right and left side faces of the coupling convex portion through the respective faces. Thus, even if the right and left leg portions are deformed plastically when the double-sided element is caulked against the fastener tape, the elements can be prevented from being deformed so that the right and left raised portions are expanded outward, whereby the double-sided element can be stably attached to the fastener tape. This makes it possible to stably manufacture a high quality slide fastener in which the double-sided elements suffering from deformation of the coupling head due to caulking are attached securely at a predetermined pitch.

In the double-sided element of the present invention, the right and left raised portions have an extending portion formed in a fixed thickness from the rear end of the slope portion toward the body portion, and the front and rear surfaces of the extending portion are formed flush with the front and rear surfaces of the body portion. Consequently, when the constructing the slide fastener with the double-sided elements of the present invention provides the following advantages. That is, when the coupling convex portion of the double-sided element is fitted to the coupling concave portion of a mating double-sided element, the coupling convex portion can be securely held by the right and left raised portions, thereby stabilizing the coupling state of the right and left double-sided element.

Further, in the double-sided element of the present invention, the front edge on the coupling convex portion side of the slope portion is disposed forward of the apex portion of the coupling convex portion. Consequently, the area in which the coupling convex portion and the right and left raised portions are integrated in a face bonding manner can be secure wide and they can reinforce each other by supporting each other, so that the coupling convex portion and the right and left raised portions can be formed further strongly.

Moreover, the inclined face of the slope portion is formed in a plane. With this configuration, in the case where the slide fastener is constructed with the double-sided elements, the right and left raised portions formed on the coupling head can be prevented from interfering with the right and left raised portions formed on a mating coupling head when the right and left elements are coupled. As a result, opening/closing of the slide fastener can be achieved stably.

Further, in the double-sided element of the present invention, the right and left raised portions are formed between the right and left side edges of the element with the coupling convex portion and the coupling concave portion interposed therebetween. Consequently, if the right and left raised portions are formed up to both the right and left side edges, no step is formed among the right and left side faces of the raised portion, the side face of the flat plate portion and the side face of the body portion. With this configuration, the side face of the element can be formed into a smooth face, thereby achieving an excellent appearance and tactile feeling.

The height from the apex portion of the coupling convex portion to the bottom face of the coupling concave portion is set smaller than the height from the apex portion to the front surface or rear surface of the thin flat plate portion. Consequently, the thickness between the bottom faces of the coupling concave portions of the front surface and the rear surface is formed larger than the thickness between the thin plate portions of the front surface and the rear surface. Therefore, the coupling convex portion and the right and left raised portions are supported by the bottom portion of the coupling concave portion and formed stronger, thereby securely preventing deformation of the coupling convex portion and the right and left raised portions. Further, by increasing the height between the apex portion of the coupling convex portion and the front and rear surfaces of the thin flat plate portion, that fastener chain can be provided with appropriate flexibility (ease of bending) when the fastener chain is constructed.

Further, because the front edge of the coupling convex portion is disposed on the front edge of the thin flat plate portion, no thin flat plate portion is disposed on the front end side of the coupling convex portion. Thus, in the slide fastener constructed with the double-sided element of the present invention, the sliding resistance of the slider is small and the operation feeling of the slider is excellent, so that the right and left elements can be smoothly coupled with each other or separated from each other. Further, because the front end face of the coupling head and the slope on the front side of the coupling convex portion on the front surface and rear surface are formed continuously not through the thin flat plate portion, the tactile feeling, for example, when the element row is touched is excellent.

Further, the front edge of the raised portion is sloped or curved in order to increase an area of the inclined face of the slope portions gradually from the both right and left side edges of the element to the coupling convex portion. In other words, in the front edge of the raised portion, the edges of the both right and left side edges of the elements of the front edge is formed or curved in order to dispose backward of a connecting portion of the coupling convex portion of the front edge. Consequently, the area where the both right and left side edges of the thin flat plate portions on the coupling head can be secured widely. Therefore, when the fastener chain is constructed with the double-sided element of the present invention, if the right and left of the element rows are in coupling state, the each element is easy to rotate toward the front surface-rear surface direction of a tape at the coupling head as pivoting point, without the prevention of the raised portions. Thus, a flexibility of the fastener chain can be improved furthermore.

The other metallic double-sided element which relates to the present invention provides a coupling head, a body portion, and a pair of right and left leg portions. The coupling head includes thin flat plate portions, coupling convex portions projection from the thin flat plate portions, right and left raised portions which are raised from the thin flat plate portion disposed on the right and left sides of each of the coupling convex portions, and extended to the body portion so as to be integrated with the body portion, and a coupling concave portion. Additionally, the coupling concave portion is surrounded by the coupling convex portion, the right and left raised portions and the body portion while at least part of the peripheral wall is formed continuously. Each of the right and left raised portions has a slope portion which is inclined from a front edge on the coupling convex portion side of the raised portion toward the body portion such that the slope portion rises with respect to the front surface and rear surface of the thin flat plate portion. Part of each inside face of the right and left slope portions is formed with part of the coupling convex portion continuously. Further, the front edge of the raised portion is sloped or curved in order to increase an area of the inclined face of the slope portions gradually from the right and left side edges of the element to the coupling convex portion. In the above, part of each inside face of the right and left slope portions is formed with part of the coupling convex portion continuously means that part of each inside face of the slope portions and part of right and left side faces of the coupling convex portions in a face bonding manner. Because in the metallic double-sided element of the present invention having such a configuration, the coupling convex portion is integrated formed with the right and left raised portions in a face bonding manner continuously, the coupling convex portion and the raised portion support each other and are formed so rigidly that they are hard to deform. Thus, when the slide fastener is constructed with the double-sided element of the present invention, the coupling convex portion and the right and left raised portions formed on the coupling head can be prevented from being deformed or chipped even if the slide fastener receives a lateral pulling force or the like while in coupling with the right and left elements. Additionally, the metallic double-sided element can be maintained the coupling state stably with an excellent coupling strength. Further, when the fastener chain is constructed with the double-sided element of the present invention, because the front edge of the raised portion is sloped or curved as stated above, the fastener chain can be provided with an excellent flexibility In the slide fastener including fastener stringers in which the metallic double-sided elements of the present invention are arranged at predetermined intervals on side edge portions opposing each other of a pair of right and left fastener tapes, the right and left double-sided elements are appropriately coupled with each other to maintain the coupling state stably. Further, even if a lateral pulling force is received in the coupling state, the coupling convex portion and the right and left raised portions can be prevented from being deformed or chipped. Consequently, a high quality slide fastener having an excellent coupling strength in which the right and left double-sided elements are not separated easily can be produced.

DESCRIPTION OF THE PREFERRED EMBODIMENTS

Hereinafter, preferred embodiments of the present invention will be described in detail with examples and reference to the accompanying drawings. The present invention is not limited to respective embodiments described below but may be modified in various ways as long as substantially the same configuration is provided and the same operation and effect are exerted.

First Embodiment

Figure 1:
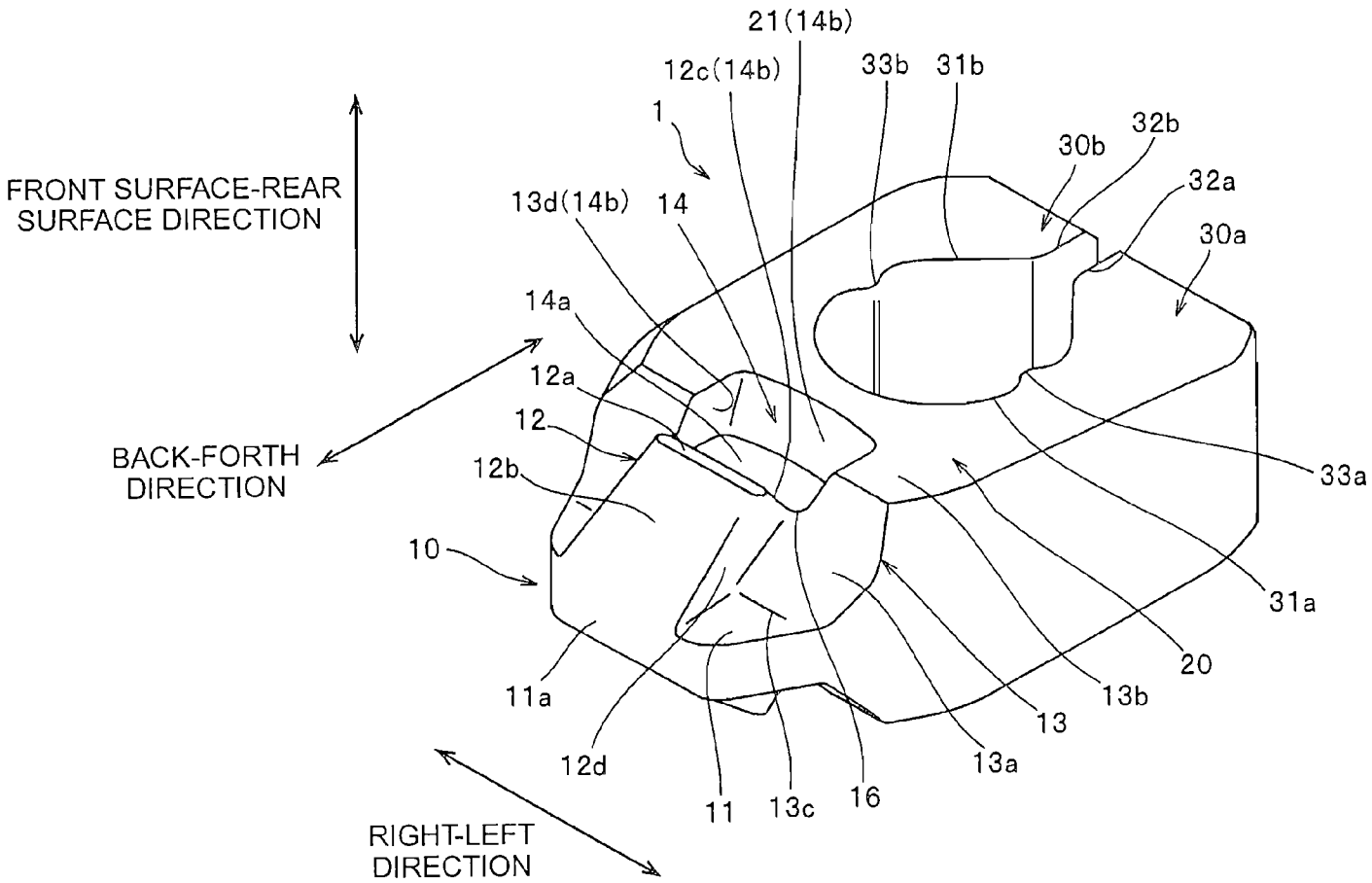
FIG. 1 is a schematic perspective view showing a state in which a metallic double-sided element of the first embodiment of the present invention is caulked.
Figure 2:
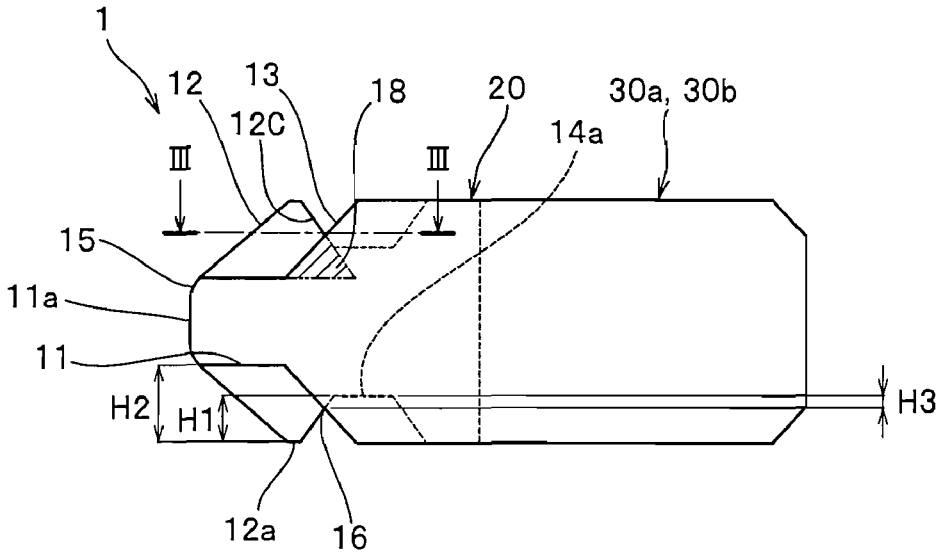
FIG. 2 is a side view of the metallic double-sided element.
Figure 3:
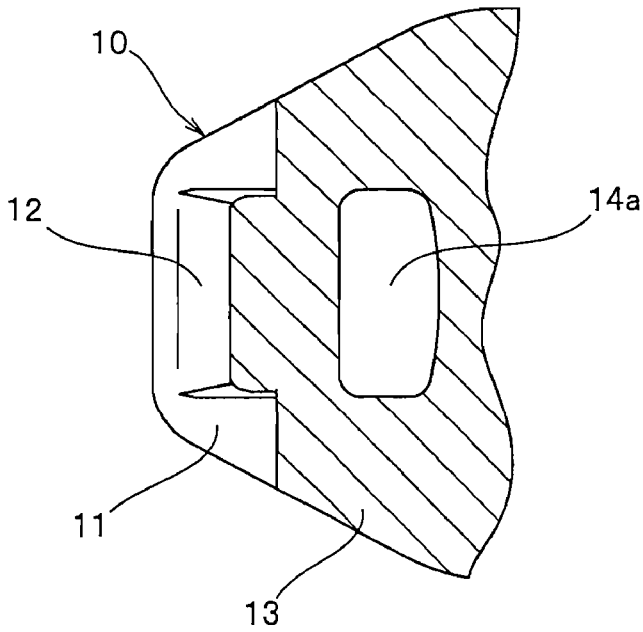
FIG. 3 is a sectional view showing part of the section taken along the line III-III in FIG. 2.

FIG. 1 is a schematic perspective view showing a state in which a metallic double-sided element of the first embodiment is caulked. FIG. 2 is a side view of the metallic double-sided element, and FIG. 3 is a sectional view showing part of the section taken along the line III-III in FIG. 2.

In the following description of the present invention, the back-forth direction of the double-sided element refers to a tape width direction when the element is attached to a fastener tape, and the right-left direction and the front surface-rear surface direction (vertical direction) of the double-sided element refer to a tape width direction and a tape length direction when the element is attached to the fastener tape.

A double-sided element 1 of the first embodiment shown in FIG. 1 is formed by pressing a metal member several times into a configuration symmetrical in the front surface-rear surface direction, having a coupling head 10 disposed at the front portion of the element, a body portion 20 formed in a predetermined thickness on the rear end side of the coupling head 10, and a pair of right and left leg portions 30*a*, 30*b* extending to the rear end side of the body portion 20.

The coupling head 10 includes thin flat plate portions 11 disposed at a central portion in the front surface-rear surface direction, coupling convex portions 12 projecting in the front surface-rear surface direction from the flat plate portion 11*s*, right and left raised portions 13 which are raised in the front surface-rear surface direction from the flat plate portions 11 disposed on the right and left sides of the coupling convex portion 12 and extend toward the body portion 20, and a coupling concave portion 14 provided concavely between the coupling convex portion 12 and the body portion 20.

The flat plate portion 11 at the coupling head 10 has a predetermined thickness smaller than the body portion 20. The right and left side edges of the thin flat plate portion 11 are formed obliquely with respect to the back-forth direction of the element such that the dimension thereof in the right-left direction decreases gradually as it goes to the front end from the body portion 20 side. The front end face 11*a* of the flat plate portion 11 is formed perpendicularly to the back-forth direction of the element.

The coupling convex portion 12 is formed in the center in the back-forth direction and the right-left direction of the flat plate portion 11 such that the coupling convex portion 12 is raised in a mountainous state in the back-forth direction. The coupling convex portion 12 has an apex portion 12*a*, a front slope portion 12*b* and a rear slope portion 12*c* disposed in front of and in the back of the apex portion 12*a*, and right and left side face portions 12*d* disposed on the right and left sides.

As shown in FIG. 2, the apex portion 12*a* of the coupling convex portion 12 is disposed at the same height position as the front and rear surfaces of the body portion 20 and formed in a predetermined length along the right-left direction of the element. The right and left side face portions 12*d* of the coupling convex portion 12 are inclined slightly so that the right and left width dimensions of the coupling convex portion 12 decrease gradually as they go toward the apex portion 12*a*. In the present invention, the back side of the apex portion 12*a* of the coupling convex portion 12 may be formed in a vertical plane perpendicular to the front and rear surfaces of the body portion instead of being formed into the rear slope portion 12*c* which is inclined backward as described above.

In the first embodiment, the position of the front edge (bottom edge of the front slope portion 12*b*) of the coupling convex portion 12 is aligned with the position of the front edge of the flat plate portion 11. Further, a border portion 15 between the front end face 11*a* of the flat plate portion 11 and the front slope portions 12*b* on the front and rear face sides of the coupling convex portion 12 is formed of a curved face, thereby constituting a smooth external face continuous without any unevenness extending from the front end face ha of the flat plate portion 11 to the front slope of the coupling head 12. Preferably, the curvature radius of the curved face formed at the border portion 15 is set to 0.1 mm or more.

The right and left raised portions 13 of the coupling head 10 are formed thick such that they are raised from the flat plate potion 11 in the front surface-rear surface direction, and disposed from the right and left sides of the coupling convex portion 12 toward the body portion 20. Preferably, a front edge 13*c* of the raised portion 13 is disposed forward of the apex portion 12*a* of the coupling head 12. The raised portion 13 has a slope portion 13*a* which is inclined upward at a predetermined angle in a backward direction from the front edge 13*c* and an extending portion 13*b* formed in a fixed thickness from the rear edge of the slope portion 13*a* toward the body portion 20, while the rear end of the extending portion 13*b* is formed integrally with the body portion 20. At this time, the inclined face of the slope portion 13*a* is formed in a plane.

In the first embodiment, the right and left raised portions 13 are formed between the right and left side edges of the element 1 with the coupling convex portion 12 and the coupling concave portion 14 interposed therebetween. Thus, there is formed no step among the right and left outside faces of the raised portion 13, the right and left side faces of the flat plate portion 11 and the right and left side faces of the body portion 20. The side face of the entire element from the side face of the coupling head 10 to the outside faces of the right and left leg portions 30*a*, 30*b* is of smooth face. Accordingly, this double-sided element 1 has an excellent appearance and provides an excellent tactile feeling.

Further, part of the inside face of the slope portion 13*a* of each of the right and left raised portions 13 is integrated with part of the right and left side faces of the coupling convex portion 12 in a face bonding manner through a predetermined area 18 (area surrounded by the inclined face of the slope portion 13*a*, an extension of the rear slope portion 12*c* of the coupling convex portion 13 and an extension of the front/rear surfaces of the flat plate portion 11) as shown in FIG. 2. Consequently, the coupling convex portion 12 and the right and left raised portions 13 support each other, so that they are difficult to deform even if an external force is applied.

The coupling concave portion 14 of the coupling head 10 is formed concavely in the front and rear surfaces of the body portion between the coupling convex portion 12 and the body portion 20. The coupling concave portion 14 has a concave portion bottom face 14*a* and a peripheral wall 14*b* elevated around the concave portion bottom face 14*a*. The concave portion bottom face 14*a* of the coupling concave portion 14 is disposed at a height position between the front/rear surfaces of the flat plate portion 11 and the front/rear surfaces of the body portion 20 in the front surface-rear surface direction, and is formed in parallel to the front/rear surfaces of the flat plate portion 11 and the front/rear surfaces of the body portion 20. Thus, in the first embodiment, a height H1 from the apex portion 12*a* of the coupling convex portion 12 to the concave portion bottom face 14*a* of the coupling concave portion 14 is set lower than a height H2 from the apex portion 12*a* to the front and rear surfaces of the flat plate portion 11 (see FIG. 2). Consequently, the thickness between the concave portion bottom faces 14*a* disposed in the front and rear surfaces of the element 1 is larger than the thickness between the front and rear surfaces of the flat plate portions 11. As a result, the rear slope portion 12*c* of the coupling convex portion 12 and each inside face of the right and left raised portions 13 are reinforced, so that the coupling convex portion 12 and the right and left raised portions 13 are solidified further.

The peripheral wall 14*b* of the coupling concave portion 14 is constituted of the rear slope portion 12*c* of the coupling convex portion 12, inner side faces 13*d* of the right and left raised portions 13, and a front end face 21 of the body portion 20. Although a valley portion 16 composed of two slopes is formed at a connecting portion between the rear slop portion 12*c* of the coupling convex portion 12 and the slope portion 13*a* of the right and left raised portions 13, the peripheral wall 14*b* of the coupling concave portion 14 is disposed between the valley portion 16 and the concave portion bottom face 14. Thus, the peripheral wall 14*b* of the coupling concave portion 14 is provided continuously throughout the entire periphery of the concave portion bottom face 14*a* (see FIG. 3).

In this case, the proportion of the interval (height H1) between an interval between the apex portion 12*a* and the bottom of the coupling concave portion 14*a* and the interval (height H3) between the valley portion 16 and the bottom of the coupling concave portion 14*a* are set larger than 0% is acceptable, however it is preferable to set the percentage range from 20 to 50% and it is more preferable to set the percentage range from 40 to 50% (see FIG. 2). For example, by setting the percentage of the height H1 and height H3 below 50%, when the slide fastener is constructed, the coupling of the right and left elements rows can be set stably. Further, by setting the percentage more than 20%, it is possible to obtain the effectively increased strength of the coupling convex portion 12 stably and by setting the percentage more than 40%, it is possible to improve the formability of the element 1.

The body portion 20 connects the coupling head 10 with the right and left leg portions 30*a*, 30*b*, and the front and rear surfaces and right and left side faces of the body portion 20 are formed flush with the front and rear surfaces and right and left side faces of the extending portion 13*b* of the coupling head 10 and the right and left leg portions 30*a*, 30*b*. The front end face 21 of the body portion 20 constituting part of the peripheral wall 14*b* of the coupling head 14 is formed into an inclined face which is inclined upward from the concave portion bottom face 14*a* toward the front and rear surfaces of the body portion.

Figure 4:
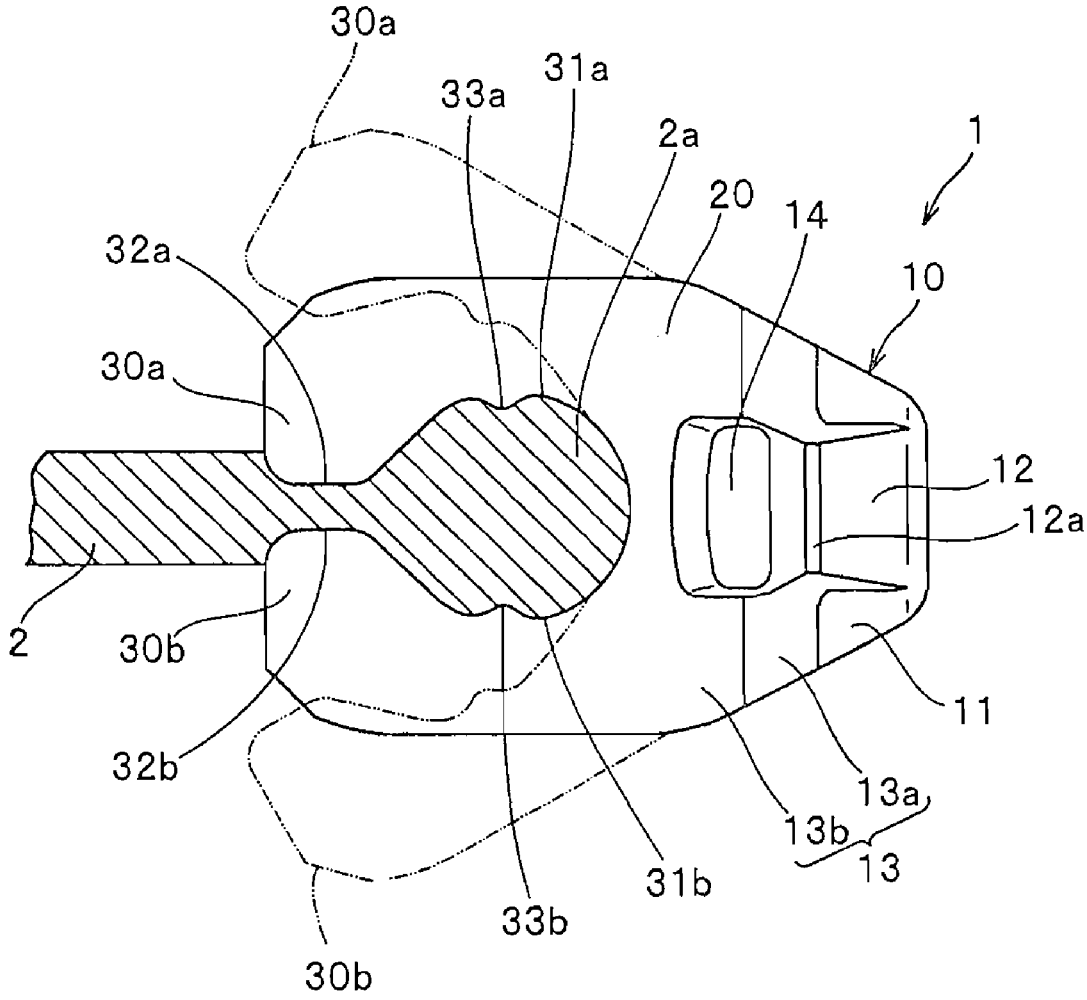
FIG. 4 is an explanatory view for explaining a state in which the metallic double-sided element is caulked against a fastener tape.

The pair of right and left leg portions 30*a*, 30*b* are branched from the rear end of the body portion 20 and extended. The right and left leg portions 30*a*, 30*b* are formed such that they are opened from the front end of the body portion 20 toward the rear end when the element 1 is processed by pressing. The leg portions 30*a*, 30*b* present a substantially Y shape when the entire element 1 is seen from above (see two-dots and dash line in FIG. 4). The right and left leg portions 30*a*, 30*b* have core thread nipping portions 31*a*, 31*b* whose inside faces are formed in a circular shape as the element is seen from above, and tape nipping portions 32*a*, 32*b* disposed at the rear end portions. Further, projecting portions 33*a*, 33*b* are provided on the inside faces of the core thread nipping portions 31*a*, 31*b* such that they are projected inward in the right-left direction.

The double-sided element 1 of the first embodiment having such a configuration may be attached to a fastener tape 2 in which a core thread portion 2*a* is provided along the side edge. In this case, the core thread portion 2*a* of the fastener tape 2 is inserted in between the right and left leg portions 30*a* and 30*b* opened of the double-sided element 1 until the core thread portion 2*a* comes into contact with the rear end face of the body portion 20. Thereafter, the right and left leg portions 30*a*, 30*b* are caulked in a direction of narrowing the opening width of the legs by pressing from the outside faces using a caulking punch or the like. Consequently, the fastener tape 2 is nipped between the right and left leg portions 30*a* and 30*b*, so that the double-sided element 1 can be implanted in the fastener tape 2.

The core thread nipping portions 31*a*, 31*b* of the right and left leg portions 30*a*, 30*b* have the projecting portions 33*a*, 33*b*. Therefore, when the right and left leg portions 30*a*, 30*b* are caulked, the projecting portions 33*a*, 33*b* bite into the core thread portion 2*a* of the fastener tape 2, so that the double-sided element 1 can be attached to the fastener tape 2 firmly.

In the double-sided element 1 of the first embodiment, the right and left raised portions 13 of the coupling head 10 are integrated with the coupling convex portion and supported strongly in a face bonding manner, and reinforced by the bottom face portion of the coupling concave portion 14. Further, the right and left raised portions 13 are formed long between both the right and left side edges of the element 1. Consequently, even if the right and left leg portions 30*a*, 30*b* are caulked when the double-sided element 1 is attached, the right and left raised portions 13 can be prevented from being deformed outward unlike conventionally, so that the configuration of the coupling head 10 can be maintained stably.

Figure 5:
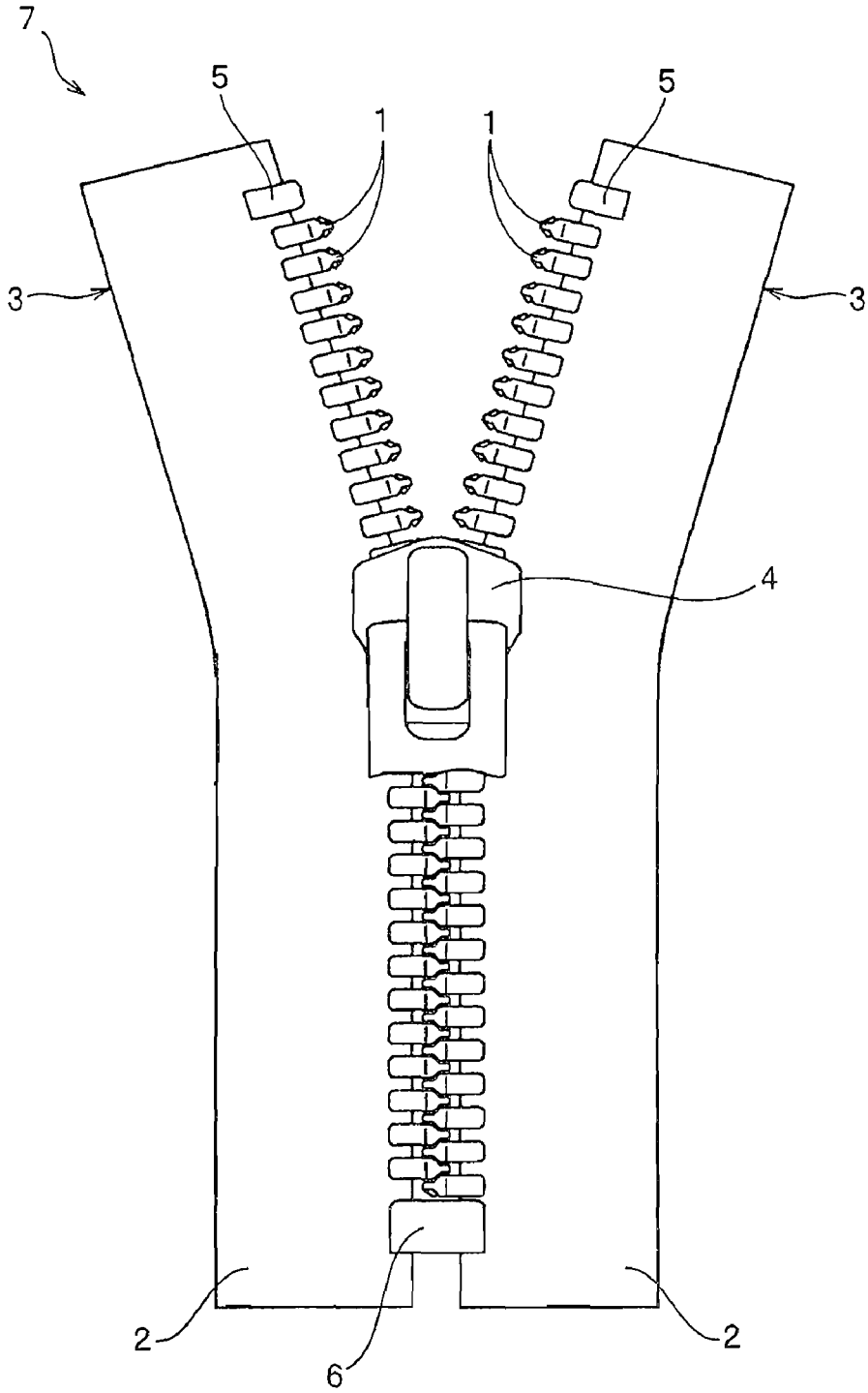
FIG. 5 is a front view showing a slide fastener constructed with the metallic double-sided element.

A plurality of the double-sided elements 1 of the first embodiment are implanted in the tape side edges of the pair of right and left fastener tapes 2 at predetermined intervals, thereby to manufacture the right and left fastener stringers 3. Then, a slider 4 is placed on the element rows of the obtained fastener stringer 3, and a top end stop 5 and a bottom end stop 6 are attached on both the front and rear end portions in a sliding direction of the element rows, whereby a slide fastener 7 shown in FIG. 5 is manufactured.

Figure 6:
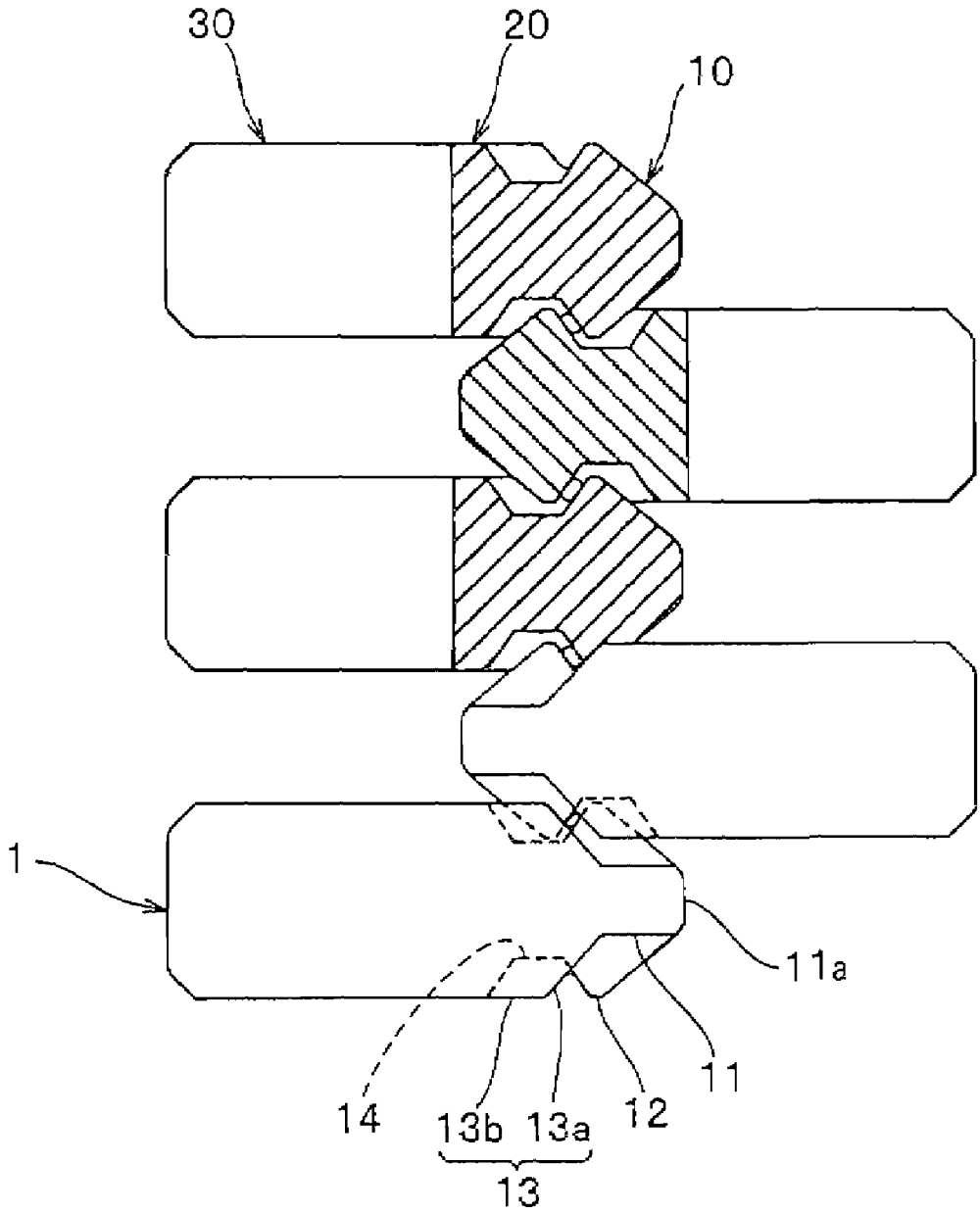
FIG. 6 is an enlarged view of major portions showing a state in which the double-sided elements of the slide fastener are coupled with each other by representing part thereof with a sectional view.

In the slide fastener 7 obtained in this way, when the slider 4 is slid in a coupling direction (a direction to the bottom top end stop 6 5), the coupling convex portion 12 of each element 1 can be fitted into each mating coupling concave portion 14 having continuously formed peripheral wall 14*b* as shown in FIG. 6. As a consequence, the double-sided elements 1 arranged on the right and left fastener tapes 2 can be coupled securely, thereby maintaining the coupling state stably.

Particularly in the double-sided element 1 of the first embodiment, the slope portion 13*a* inclined at a predetermined angle is disposed on the front end side of each of the right and left raised portions 13 formed on the coupling head 10, and further, the inclined face of the slope portion 13*a* is constructed of a plane. Thus, when the right and left double-sided elements 1 get into coupling as described above, the respective raised portions 13 disposed on the right and left double-sided elements 1 do not interfere with each other, thereby smoothly closing the slide fastener 7.

In the double-sided element 1 of the first embodiment, the coupling convex portion 12 is integrated with the right and left raised portions 13 in a face bonding manner so as to be formed strongly, and the double-sided element 1 is reinforced by the bottom face portion of the coupling concave portion 14. Thus, even if the right and left elements 1 receive an external force such as a lateral pulling force when they are coupled with each other, the coupling convex portion 12 and the right and left raised portions 13 can be prevented from being deformed or chipped effectively. Consequently, the slide fastener 7 constructed with the double-sided element 1 of the first embodiment can secure an excellent coupling strength stably.

Further, in the slide fastener 7 constructed with the double-sided element 1 of the first embodiment, the interval (height H2) between the apex portion 12*a* of the coupling convex portion 12 of the coupling head 10 and each of the front surface and rear surfaces of the flat plate portion 11 is set larger than the interval (height Hi) between the apex portion 12*a* and the coupling concave portion bottom face 14*a*. With this configuration, the slide fastener 7 can secure an appropriate flexibility even when it is closed. Thus, the slide fastener 7 can be used preferably in various applications.

Additionally, because the coupling head 10 of each double-sided element 1 has an external face without any unevenness continuous from the front end face 11*a* of the flat plate portion 11 to the front slope portion 12*b* of the coupling convex portion 12, the tactile feeling of the right and left element rows of the slide fastener 7 is excellent. Further, because right and left element rows are formed of such double-sided elements 1, sliding resistance of the slider 4which slides on the element rows can be suppressed thereby to improve operating feeling of the slider 4.

In this case, the curvature radius of the curved face formed on the border portion 15 between the front end face 11*a* of the flat plate portion 11 and the front slope portion 12*b* of the coupling convex portion 12 at the coupling head 10 of the double-sided element 1 is set to 0.1 mm or more. Thus, it is possible to obtain the high quality slide fastener 7 largely improved in the tactile feeling of the element rows and the operating feeling of the slider 4.

Second Embodiment

Figure 7:
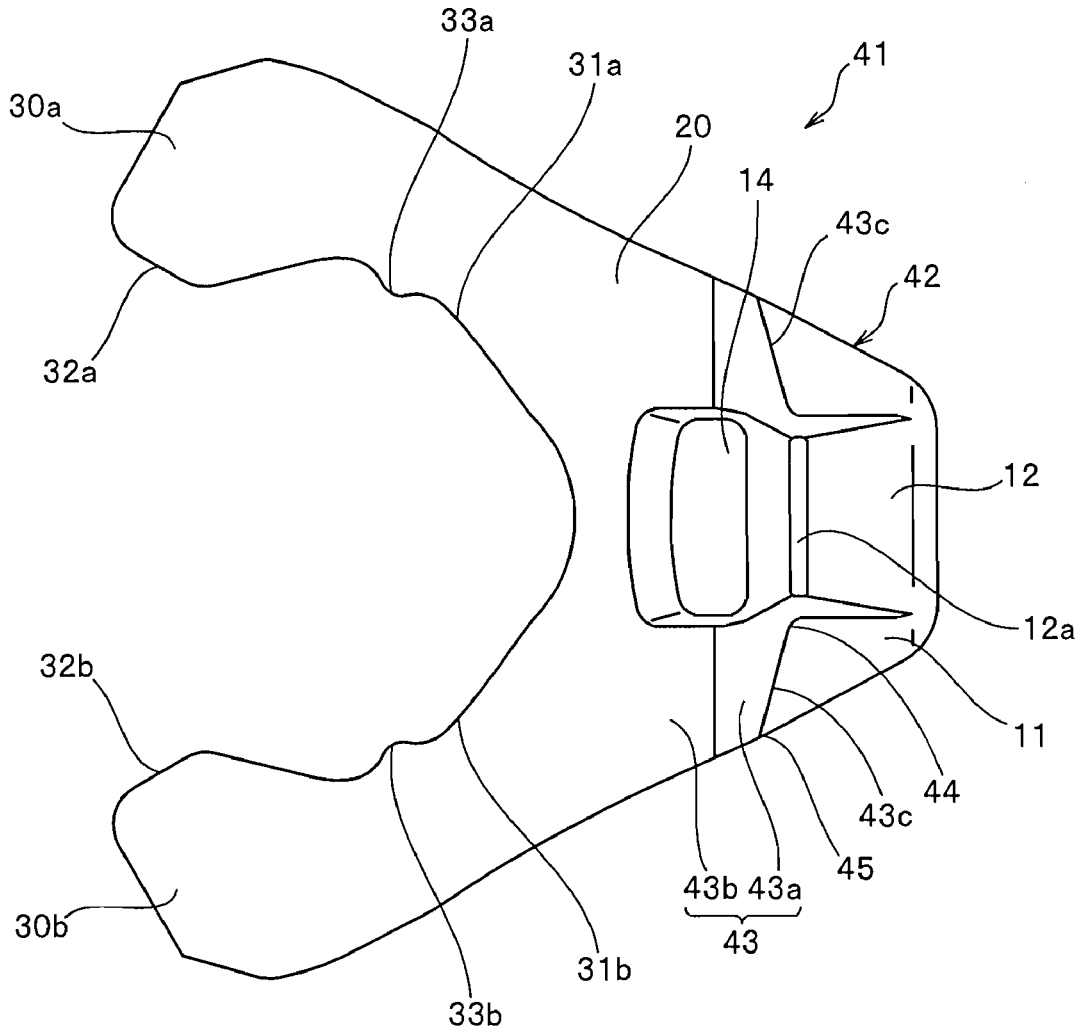
FIG. 7 is a top view showing a metallic double-sided element of the second embodiment of the present invention.
Figure 8:
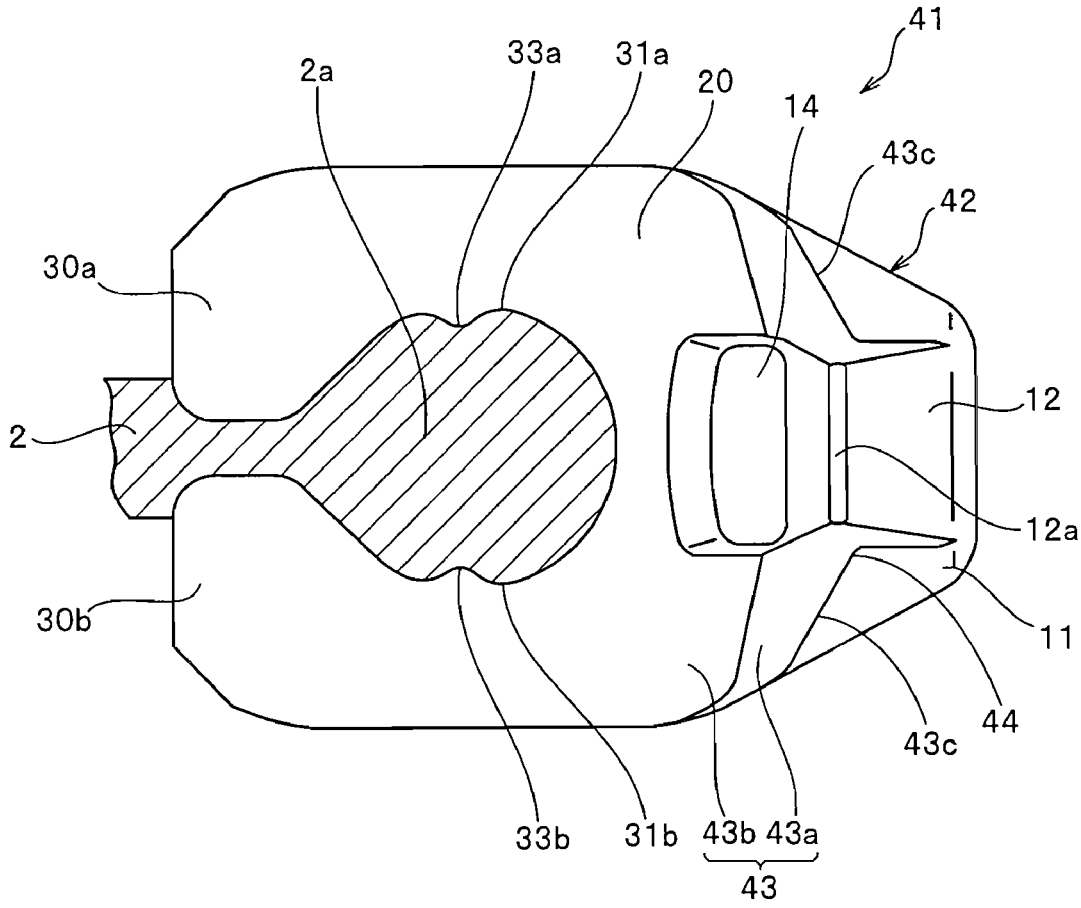
FIG. 8 is a perspective view showing a state of the metallic double-side element is caulked against a fastener tape.

FIG. 7 is a top view showing a metallic double-sided element. FIG. 8 is a perspective view for explaining a state in which the metallic double-sided element is caulked against a fastener tape.

In the explanation of the second embodiment and the reference drawings, the same reference numbers are used in a part where shares with the metallic double-sided element of the first embodiment of the first embodiment and the part of the explanation are omitted.

The double-sided element 41 of the second embodiment is formed into a symmetrical shape in regard to its back-forth direction, having a coupling head 42 disposed at the front portion of the element, a body portion 20 formed in a predetermined thickness on the rear end side of the coupling head 42, and a pair of right and left leg portions 30*a*, 31*b* extending to the rear end side of the body portion 20.

The coupling head 42 includes thin flat plate portions 11 disposed at a central portion in the front surface-rear surface direction, coupling convex portions 12 projecting in the front surface-rear surface direction from the flat plate portion 11, right and left raised portions 43 which are raised in the front surface-rear surface direction from the flat plate portions 11 disposed on the right and left sides of the coupling convex portion 12 and extend toward the body portion 20, and a coupling concave portion 14 provided concavely between the coupling convex portion 12 and the body portion 20. The right and left raised portions 43 is formed thick such that raised they are raised from the flat plate portion 11 in the front surface-rear surface direction, and disposed form the right and left sides of the coupling portion 12 toward the body portion 20. The raised portions 43 are formed between the right and left side edges of the element 41 with the coupling convex portion 12 and the coupling concave portion 14 interposed therebetween.

The raised portions 43 has a slope portion 43*a* which is inclined upward at a predetermined angle in a backward direction from the front edge 43*c* and an extending portion 43*b* formed in a fixed thickness from the rear edge of the slope portion 43*a* toward the body portion 20, while the slope portion 43*a* is formed in a plane.

Further, the right and left raised portions 43 is formed with the part of the coupling convex portion 12 continually in a face bonding manner, and the coupling concave portion 14 and the right and left raised portions 43 are supported each other.

The double-sided element 41 of the second embodiment as shown in FIG. 7, a front edge 45 of the both right and left side edges of the front edge 43*c* is disposed backward of a connecting portion at the convex portion 12 of the front edge 43*c* and the front edge 43*c* of the right and left raised portions 43 is formed linearly. In other words, the front edge 43*c* of the right and left of the raised portions 43 are formed a slope in order to increase an area of the inclined face of the slope portion 43*a* gradually from the both right and left side edges of the element 1 to the coupling convex portion 12. It is also, the front edge of the right and left raised portions of the present invention is formed a slope in order to increase an area of the inclined face of the slope portion gradually toward the coupling convex portion.

The double-sided element 41 of the second embodiment having such a configuration may be attached to a fastener tape 2 in which core thread portion 2*a* is provided. In this case, the core thread portion 2*a* of the fastener tape 2 is inserted in between the right and left leg portions 30*a* and 30*b* of the double-sided element 1, thereafter the right and left leg portions 30*a*, 30*b* are caulked using a caulking punch or the like. Consequently, the fastener tape 2 is nipped between the right and left portions 30*a* and 30*b*, so that the double-sided element 1 can be implanted in the fastener tape 2.

When the right and left leg portions 30*a*, 30*b* are caulked in this way, the part of the slope portion 43*a* and the extending portion 43*b* are bended toward the right and left leg portions 30*a*, 30*b* (outward) along with the right and left leg portions 30*a*, 30*b* are deformed plastically. This is as to the part of the slope portion 43*a* of the element of the both right and left side edges whose length is shorter than that of the inside face (the connection portion 44) in the back-forth direction, and the inside face of the slope portion 43*a* is formed with the coupling convex portion 12 continuously.

That is, if the inside face of the slope portion 43*a* is formed integrally with the coupling convex portion 12 when the right and left leg portions 30*a*, 30*b* are in caulking, the slope portion 43 of the element of the part of the both right and left side edges receives an external force and the slope portion 43 of the element of the both right and left side edges are bended with pulling force toward the right and left leg portion 30*a*, 30*b*. With such the force, the extending portion 43*b* of the element of the part of the both right and left side edges are bended accordingly.

On the other hand, as sated in the above, even the slope portions 43*a* of the element of the both right and left side edges are bended, since the inside face (the connecting portion 44) of the slope portion 43*a* and the coupling convex portion 12 are reinforced in a face bonding manner, it is possible to maintain the stable shape of the coupling head 10 by preventing from being deformed.

When the slider 4 is slid, the slide fastener which successfully implanted the double-sided element 41 of the second embodiment in the fastener tape 2 can be coupled with the double-sided element 1 which are arranged on the right and left fastener tape 2 securely and smoothly and maintain the stable coupling state.

In the double-sided element 41 of the second embodiment, the coupling convex portion 12 is integrated with the right and left raised portions 43*a* in a face bonding manner so as to be formed strongly at the bottom face portion of the concave portion 14. Thus, even if the right and left elements 1 receive an external force such as a lateral pulling force when they are coupled with each other, the coupling convex portion 12 can be prevented from being deformed or chipped effectively.

In addition, the slide fastener 7 constructed with the double-sided element 1 of the second embodiment having the front edge 43*c* of the right and left raised portions 43 on the double-sided element 41 is inclined as stated above and the ends 45 of the both right and left side edges of the element of the front edge 43*c* is disposed backward of the connecting portion 44 of the frond edge 43*c* and the coupling convex portion 12.

Figure 9:
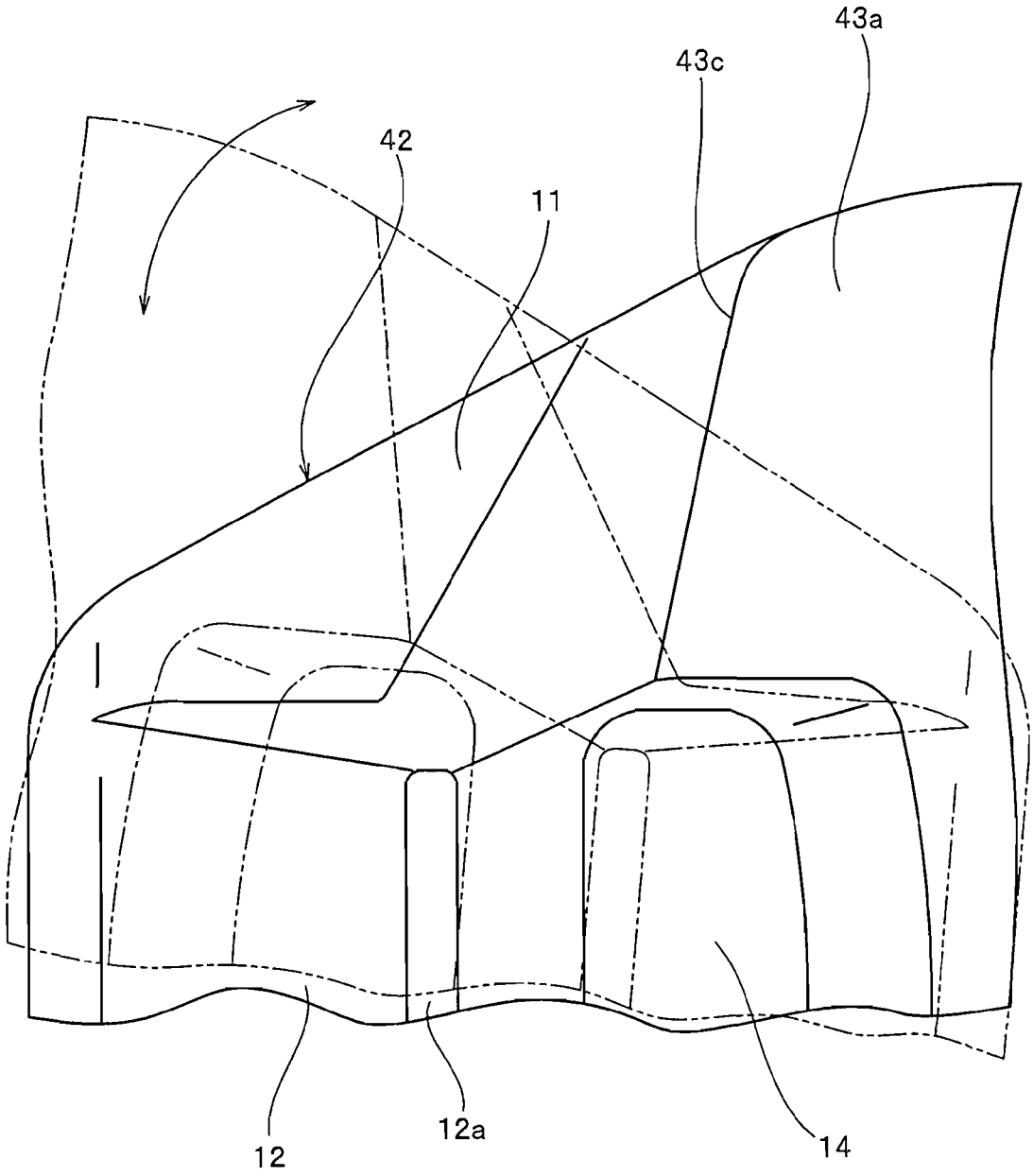
FIG. 9 is an explanation view for explaining a sate in which right and left elements are coupled on a slide fastener which constituted with the metallic double-sided element.
Figure 10:
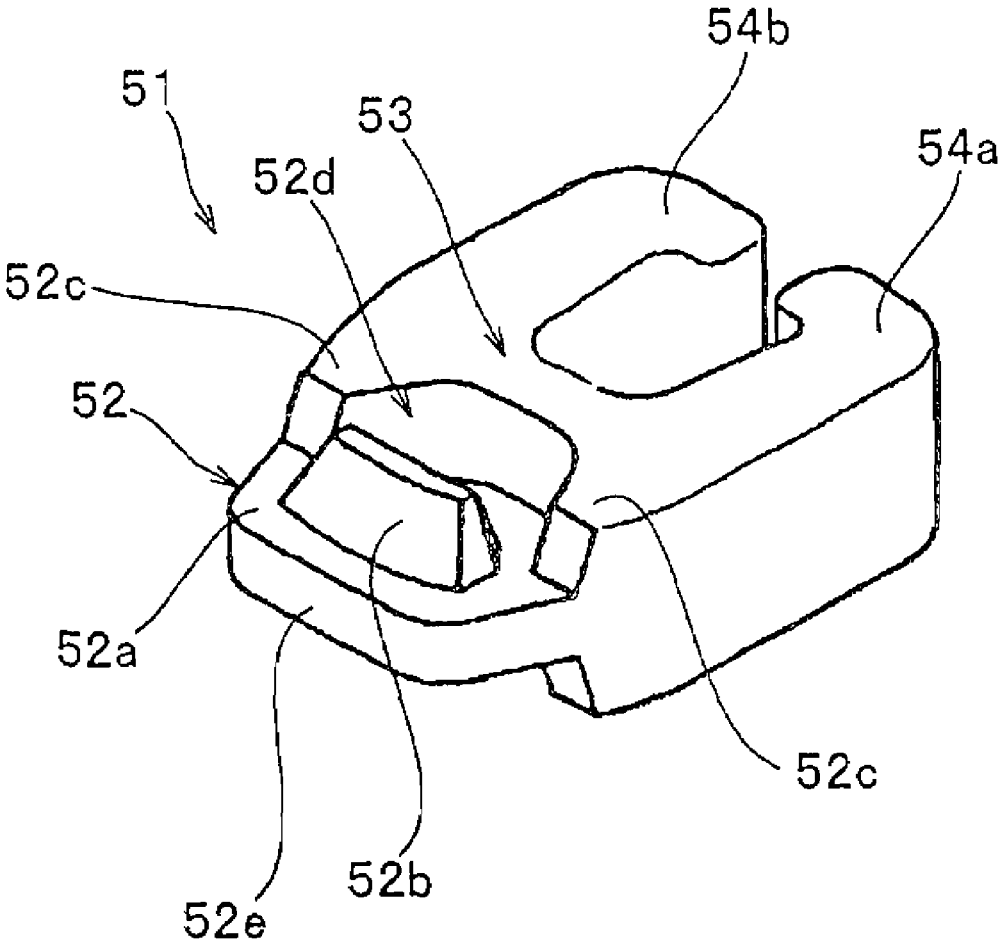
FIG. 10 PRIOR ART
FIG. 10 is a schematic perspective view showing a conventional double-sided element.
Figure 11:
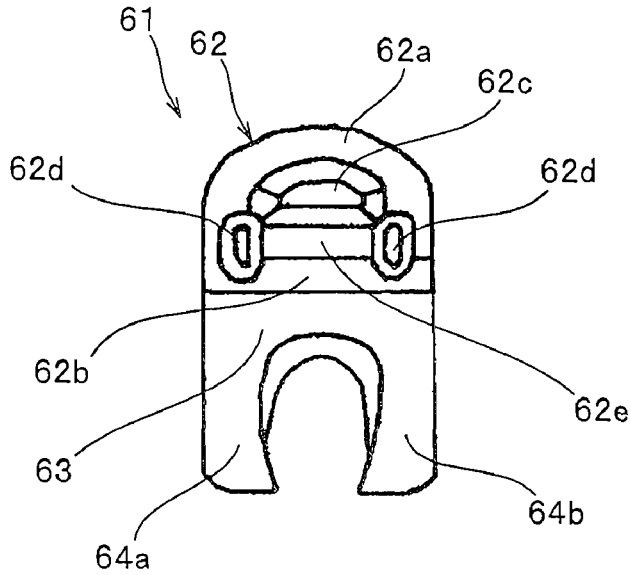
FIG. 11 PRIOR ART
FIG. 11 is a schematic top view showing another conventional double-sided element.
Figure 12:
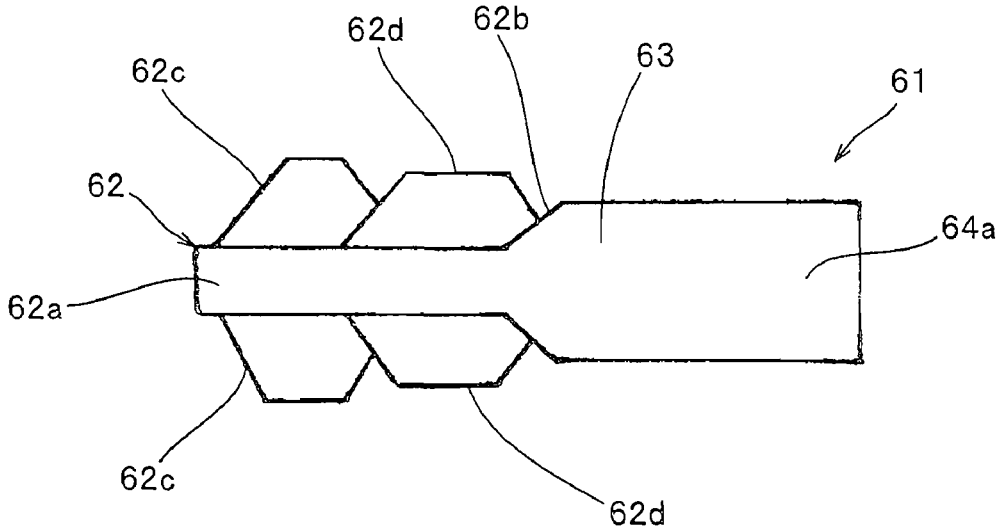
FIG. 12 PRIOR ART
FIG. 12 is a schematic side view showing the double-sided element.

For this reason, as shown in the FIG. 9, if the right and left of the element rows are in a coupling state without prevention of the right and left raised portions, it is possible to rotate the each element at the coupling head as pivoting point in the right-left direction (the front surface-rear surface tape direction). Therefore, the slide fastener can be secured the excellent flexibility easily and can be extended its application widely. In this case, since the slope of the front edge 43*c* of the right and left raised portions 43 are increased, it is possible to expand the area of the rotation of the each element.

In the above first and second embodiments, description has been made of an example that the double-sided element of the present invention is applied to an ordinary type slide fastener in which a single slider is disposed in a fastener chain thereof. However, the double-sided element of the present invention is not restricted to this example, but the double-sided element may be used in a slide fastener having two sliders in which the two sliders are arranged on the fastener chain such that their heads or tails oppose each other likewise.

The present invention is preferably applicable as an element for a slide fastener to be attached to an opening in bags, clothes or the like.

What is claimed is:

1. A metallic double-sided element including a coupling head, a body portion disposed on the rear end side of the coupling head and a pair of right and left leg portions extending to the rear end side of the body portion, wherein the coupling head includes:

thin flat plate portions whose thickness between its front surface and rear surface is smaller than that of the body portion;

coupling convex portions projecting in the front surface-rear surface direction at a central portion in the right-left direction of the thin flat plate portion;

right and left raised portions which are raised in the front surface-rear surface direction from the thin flat plate portions disposed on the right and left sides of each of the coupling convex portions, and extend to the body portion so as to be integrated with the body portion; and a coupling concave portion which is formed to be continuously surrounded by a peripheral wall of one of the coupling convex portions, the right and left raised portions and the body portion, wherein each of the right and left raised portions has a slope portion which is inclined from a front edge on the coupling convex portion side of the raised portion toward the body portion such that the slope portion rises with respect to the front surface and rear surface of the thin flat plate portion, the right and left raised portions being formed between both right and left side edges of he element with the one coupling convex portion and the coupling concave portion interposed therebetween, and part of each inside face of the right and left slope portions is integrated with part of right and left side faces of the coupling convex portion in a face bonding manner.

2. The metallic double-sided element according to claim 1, wherein each of the right and left raised portions has an extending portion formed in a fixed thickness from the rear end of the slope portion to the body portion, and the front and rear surfaces of the extending portion are formed flush with the front and rear surfaces of the body portion.

3. The metallic double-sided element according to claim 1, wherein the front edge on the coupling convex portion side slope portion is disposed forward of an apex portion of the one coupling convex portion.

4. The metallic double-sided element according to claim 1, wherein the inclined face of the slope portion is formed in a plane.

5. The metallic double-sided element according to claim 1, wherein the height from an apex portion of each coupling convex portion to a bottom face of the coupling concave portion is set smaller than the height from the apex portion to the front surface or rear surface of the thin flat plate portion.

6. The metallic double-sided element according to claim 1, wherein the front end of each coupling convex portion is disposed on the front end of the thin flat plate portion.

7. The metallic double-sided element according to claim 1, wherein the front edge of the raised portion is sloped or curved so as to increase an area of the inclined face of the slope portions gradually from the both right and left side edges of the element to the one coupling convex portion.

8. A metallic double-sided element comprising a coupling head, a body portion disposed on a rear end side of the coupling head and a pair of right and left leg portions extending to the rear end side of the body portion, wherein the coupling head includes:

thin flat plate portions whose thickness between its front surface and rear surface is formed to be smaller than that of the body portion:

coupling convex portions projecting in a front surface-rear surface direction at a central portion in a right-left direction of the thin flat plate portions;

right and left raised portions which are raised in the front surface-rear surface direction from the thin flat plate portions disposed on right and left sides of each of the coupling convex portions, and extend to the body portion so as to be integrated with the body portion; and a coupling concave portion, which is formed to be continuously surrounded by a peripheral wall of the coupling convex portions, the right and left raised portions, and the body portion, wherein each of the right and left raised portions has a slope portion which is inclined from a front edge on the coupling convex portion side raised portion toward the body portion such that the slope portion rises with respect to the front surface and rear surface of the thin flat plate portion, and a part of each of the right and left slope portions is formed continuously with a part of the coupling convex portion integrally, and the front edge of the raised portion is sloped or curved so as to increase an area of an inclined face of the slope portions gradually from the both right and left side edges element to the coupling convex portion.

9. A slide fastener including stringers in which the metallic double-sided elements according to claim 1 are arranged at predetermined intervals on side edge portions opposing each other of a pair of right and left fastener tapes.

* * * * *